US009793043B2

(12) United States Patent
Yamaguchi

(10) Patent No.: US 9,793,043 B2
(45) Date of Patent: Oct. 17, 2017

(54) COIL COMPONENT AND ELECTRONIC CIRCUIT

(71) Applicant: Sumida Corporation, Tokyo (JP)

(72) Inventor: Takayuki Yamaguchi, Natori (JP)

(73) Assignee: SUMIDA CORPORATION (JP)

( * ) Notice: Subject to any disclaimer, the term of this patent is extended or adjusted under 35 U.S.C. 154(b) by 248 days.

(21) Appl. No.: 14/698,028

(22) Filed: Apr. 28, 2015

(65) Prior Publication Data

US 2015/0325357 A1 Nov. 12, 2015

(30) Foreign Application Priority Data

May 12, 2014 (JP) ..... 2014-098518

(51) Int. Cl.

| | |
|---|---|
| ***H01F 27/02*** | (2006.01) |
| ***H01F 27/29*** | (2006.01) |
| ***H01F 27/06*** | (2006.01) |
| ***H01F 27/24*** | (2006.01) |
| ***H01F 27/26*** | (2006.01) |
| ***H01F 17/04*** | (2006.01) |

(52) U.S. Cl.

CPC ..... *H01F 27/292* (2013.01); *H01F 17/045* (2013.01); *H01F 27/02* (2013.01); *H01F 27/022* (2013.01); *H01F 27/06* (2013.01); *H01F 27/24* (2013.01); *H01F 27/266* (2013.01); *H01F 27/29* (2013.01); *H01F 2027/065* (2013.01)

(58) Field of Classification Search

CPC ..... H01F 5/00; H01F 27/00–27/30

USPC ..... 336/65, 83, 192, 196, 198, 220–223, 336/232–234

See application file for complete search history.

(56) References Cited

U.S. PATENT DOCUMENTS

| | | | | |
|---|---|---|---|---|
| 6,950,002 | B2 * | 9/2005 | Sano | H01F 17/045 336/65 |
| 8,508,322 | B2 * | 8/2013 | Yamada | H01F 17/045 336/192 |
| 2007/0018770 | A1 * | 1/2007 | Kamio | H01F 3/14 336/221 |
| 2011/0267163 | A1 | 11/2011 | Gerfer | |

FOREIGN PATENT DOCUMENTS

| | | | |
|---|---|---|---|
| CN | 1901108 | A | 1/2007 |
| CN | 102237180 | A | 11/2011 |
| JP | 2003-257741 | A | 9/2003 |

(Continued)

*Primary Examiner* — Tuyen Nguyen

(74) *Attorney, Agent, or Firm* — Harness, Dickey & Pierce, P.L.C.

(57) ABSTRACT

Provided are a coil component capable of preventing internal residence of air bubbles after encapsulated with a resin and an electronic circuit incorporating such coil component. The coil component (10) includes: a columnar core having a flange portion (210) which is formed to have a diameter larger than that of a shaft portion having a coil wound therearound; and an annular core having an opening (110) through which the columnar core is inserted, the perimeter of the inner flange face of the flange portion (210) being configured by externally disposed regions (211,212,213, 214) which are positioned outside the inner face of the opening (110) in the radial direction, and internally disposed regions (215,216,217,218) which are positioned inside the inner face of the opening (110) in the radial direction.

16 Claims, 7 Drawing Sheets

(56) References Cited

FOREIGN PATENT DOCUMENTS

| | | | | |
|---|---|---|---|---|
| JP | 2013008797 | A | * | 1/2013 |
| JP | 3186764 | U | | 10/2013 |
| JP | 3186766 | U | | 10/2013 |

* cited by examiner

COIL COMPONENT AND ELECTRONIC CIRCUIT

This application is based on Japanese patent application No. 2014-098518, filed on May 12, 2014, the content of which is incorporated hereinto by reference.

BACKGROUND

Technical Field

The present invention relates to a coil component and an electronic circuit incorporating the coil component.

Related Art

There has been known a coil component configured to arrange a ring core so as to surround the exterior of a drum core around which a coil is wound, aimed at amplifying a magnetic field which is generated around the coil by the drum core and the ring core to thereby increase the inductance.

This sort of coil component is disclosed, for example, in Japanese Laid-Open Patent Publication No. (JP-A-) 2003-257741.

JP-A-2003-257741 describes a coil component configured as described above, in which the drum core is coated with a polyimide-base insulating paint so as to form a core gap by a layer of such insulating paint, to thereby achieve an appropriate inductance value and DC (Direct Current) superimposition characteristic.

SUMMARY

When the coil component is encapsulated with a resin, air bubbles may be entrained together with the resin inside the coil component. Such entrainment of air bubbles may accelerate quality degradation of the coil component with time.

Referring now to the coil component configured as described in JP-A-2003-257741, the edge of the flange portion of the drum core is placed over the entire perimeter thereof onto the ring core, so as to close a recess of the ring core from the top. Accordingly, when the coil component is encapsulated with the resin, air bubbles may stay inside the ring core, leaving a room for quality improvement from the viewpoint of durability of the coil component.

The present invention was conceived to solve the problems described above, and an object thereof is to provide a coil component capable of preventing internal residence of air bubbles after encapsulated with a resin, and, an electronic circuit incorporating such coil component.

According to the present invention, there is provided a coil component which includes:

a columnar core which includes a shaft portion having a coil wound therearound, and a flange portion formed at least at one end portion of the shaft portion, given a diameter larger than that of the shaft portion; and an annular core which includes an opening through which the columnar core is inserted, and a housing portion which houses the columnar core inserted through the opening, the perimeter of an inner flange face of the flange portion being configured by an externally disposed region which is positioned outside the inner face of the opening in the radial direction, and an internally disposed region which is positioned inside the inner face of the opening in the radial direction.

According to the present invention, there is also provided an electronic circuit which includes the coil component described above and other electronic component(s) mounted on a board, and, at least the coil component being encapsulated with a resin.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

Figure 1:
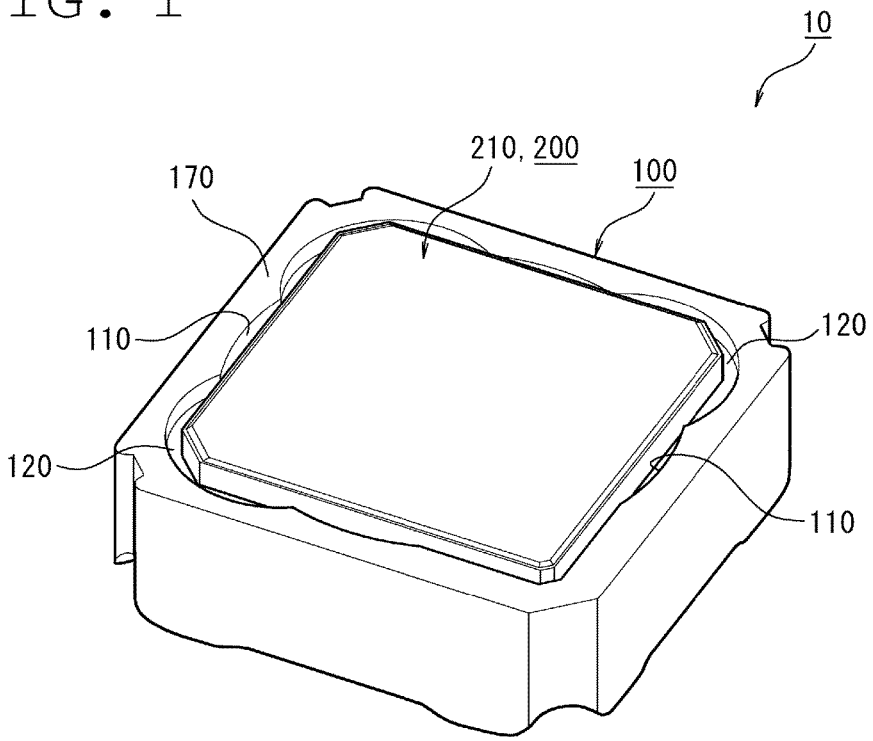
FIG. 1 is a perspective view of a coil component according to an embodiment of the present invention.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Embodiments of the present invention will be explained referring to the attached drawings. In all drawings, all identical constituents will be given the same reference numerals and/or symbols, so as to avoid repetitive explanation for the convenience.

<Coil Component 10>

Figure 2:
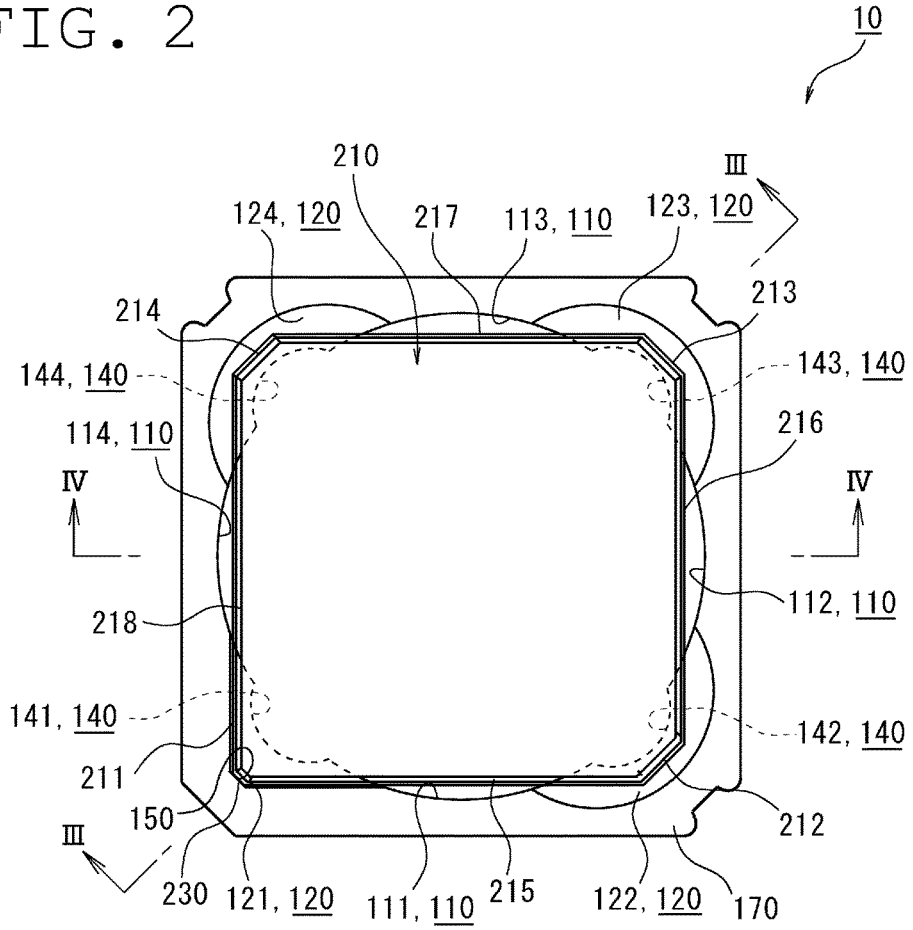
FIG. 2 is a plan view of the coil component viewed from the top face.
Figure 3:
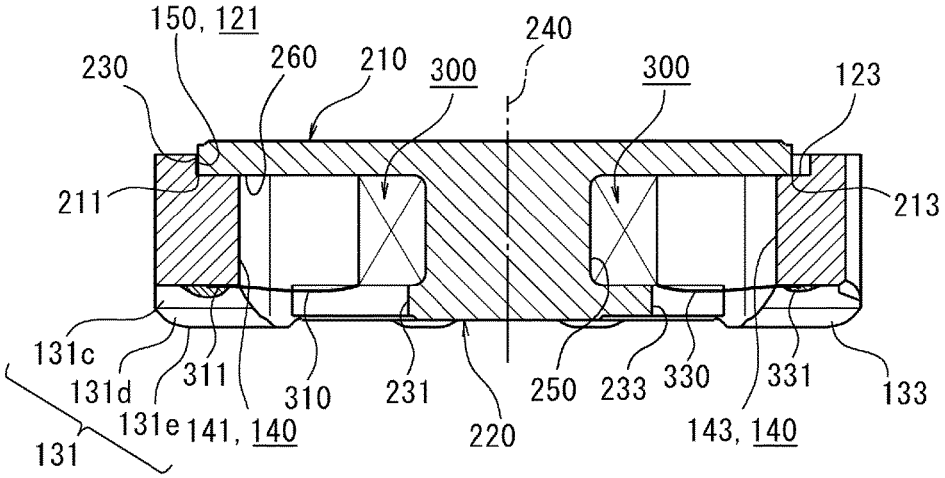
FIG. 3 is a cross sectional view taken along line in FIG. 2.
Figure 4:
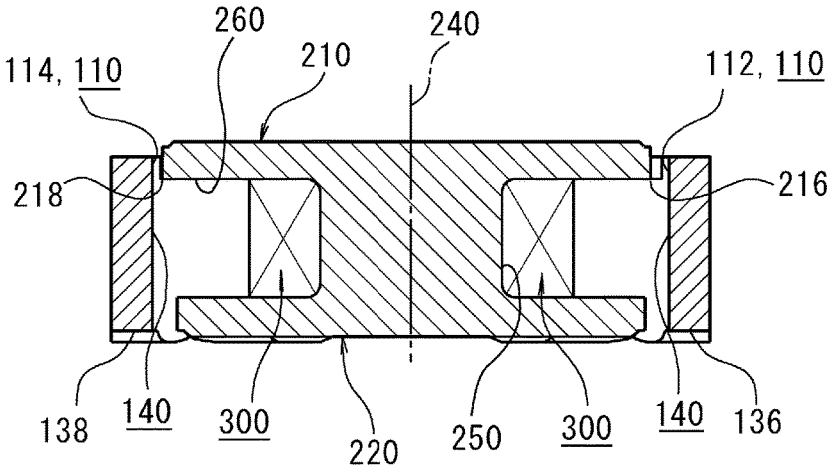
FIG. 4 is across sectional view taken along line IV-IV in FIG. 2.
Figure 5:
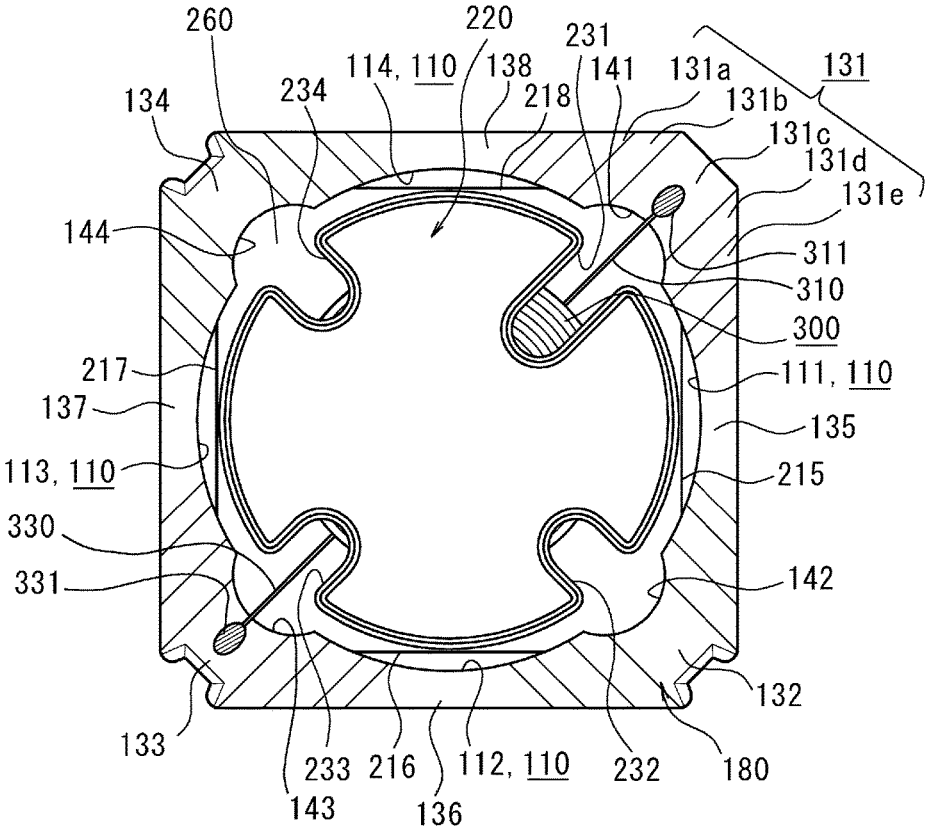
FIG. 5 is a plan view of the coil component viewed from the bottom face.
Figure 6:
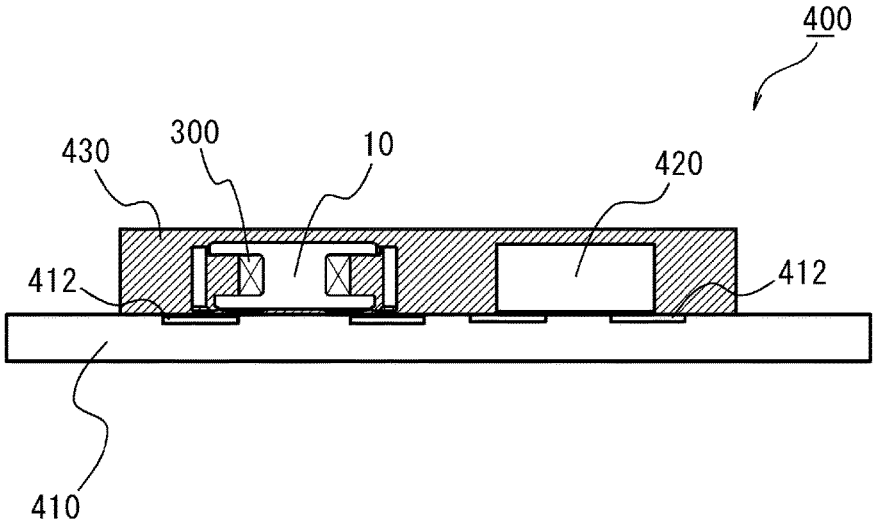
FIG. 6 is a schematic drawing of an electronic circuit having the coil component mounted on a board.

A coil component 10 and an electronic circuit 400 according to an embodiment of the present invention will be explained below, referring to FIG. 1 to FIG. 6. FIG. 1 is a perspective view of the coil component 10 according to an embodiment of the present invention. FIG. 2 is a plan view of the coil component 10 viewed from a top face 170. FIG. 3 is a cross sectional view taken along line in FIG. 2. FIG. 4 is across sectional view taken along line IV-IV in FIG. 2. FIG. 5 is a plan view of the coil component 10 viewed from a bottom face 180. FIG. 6 is a schematic drawing of an electronic circuit 400 having the coil component 10 mounted on a board 410.

As for the coil component 10 of this embodiment, one surface thereof faced to the board 410 when mounted on such board 410 will be referred to as the bottom face 180, and the opposite surface will be referred to as the top face 170. Unless otherwise specifically noted, the direction towards the top face 170 will be referred to as "top" or "upper", and the direction towards the bottom face 180 will be referred to as "bottom" or "lower".

The coil component 10 has a columnar core 200 and an annular core 100.

The columnar core 200 is a so-called drum core, and has a shaft portion 250 having a coil 300 wound therearound, and a flange portion 210 formed at least on one end portion of the shaft portion 250, given a diameter larger than that of the shaft portion 250.

The annular core 100 is a so-called ring core, and has an opening 110 through which the columnar core 200 is inserted, and a housing portion 140 which houses the columnar core 200 inserted through the opening 110.

The perimeter of an inner flange face 260 of the flange portion 210 (see FIG. 3 to FIG. 5) is configured by externally disposed regions 211, 212, 213, 214 which are positioned outside the inner face of the opening 110 in the radial direction, and internally disposed regions 215, 216, 217, 218 which are positioned inside the inner face of the opening 110 in the radial direction. In other words, when the coil component 10 is viewed from the top, the externally disposed regions 211, 212, 213, 214 extend so as to overlap with the wall which forms the opening 110 of the annular core 100, meanwhile the internally disposed regions 215, 216, 217, 218 are spaced apart from the inner face of the opening 110 to thereby form gaps 111, 112, 113 and 114 (see FIG. 2) in between.

When the coil component 10, having the features described above, is encapsulated with a resin, the resin flows into the gaps 111, 112, 113 and 114. Accordingly, the amount of air bubbles which possibly stay inside the coil component 10 may be reduced.

Relative position of the columnar core 200 and the annular core 100 in the coil component 10 is adjustable with reference to a point where the annular core 100 (wall surface of the opening 110) and the columnar core 200 (a part of flange portion 210) overlap with each other.

The coil component 10 is a component (element) which contains a coil (coil 300, for example) formed by winding a conducting wire in an annular form or in a spiral form, capable of storing energy in a magnetic field formed by current flowing in the coil. More specifically, the coil component 10 is a surface mounting coil used in a micro-module package.

Micro-module means an electronic circuit configured by mounting electronic components on one substrate or a plurality of substrates stacked and interconnected with each other having an identical shape. The micro-module package is a term indicating one package (unit component) having a number of components which configure the micro-module molded therein with resin.

The micro-module having the coil component 10 incorporated therein is as follows. The micro-module is an electronic circuit 400 having the coil component 10 and other electronic component 420 mounted together on a board 410 as illustrated in FIG. 6, and, at least the coil component 10 is encapsulated with a resin 430. The board 410 has a plurality of electrodes 412 provided on the surface thereof, and the coil component 10 and the other electronic component 420 are respectively connected to the electrodes 412.

The coil component 10 has the columnar core 200 and the annular core 100. The columnar core 200 has a shaft portion 250 having a coil 300 wound therearound, and a flange portion 210 formed at least at one end portion of the shaft portion 250, given a diameter larger than that of the shaft portion 250. The annular core 100 has an opening 110 through which the columnar core 200 is inserted, and a housing portion 140 which houses the columnar core 200 inserted through the opening 110. The perimeter of an inner flange face 260 of the flange portion 210 is configured by the externally disposed regions 211, 212, 213, 214 which are positioned outside the inner face of the opening 110 in the radial direction, and the internally disposed regions 215, 216, 217, 218 which are positioned inside the inner face of the opening 110 in the radial direction.

As illustrated in FIG. 6, both of the coil component 10 and the other electronic component 420 are preferably encapsulated with the resin 430. In more details, the coil component 10 and the other electronic component 420 are preferably encapsulated with a series of layer of a single species of resin 430. The resin used for the encapsulation is exemplified by epoxy resin.

The annular shape of the annular core 100 means that the annular core 100 in a plan view has a shape (circle, rectangle, etc.) which surrounds a certain area on a plane, or, has a shape (C-shape, U-shape, etc.) which surrounds a certain area on a plane with a partial omission of the contour. The partial omission of the contour of the annular core 100 means that the core has a gap which is narrow enough to function as a coil gap.

The columnar shape of the columnar core 200 means that the columnar core 200 has a column-like shape. More specifically, the columnar core 200 may be shaped so that the side circumferential face stands upright relative to the top face 170 or the bottom face 180 of the coil component 10; so that the side circumferential face swells in the middle thereof; so that the side circumferential face shrunk in the middle thereof; or, so that the side circumferential face has a local protrusion (flange portion 210, flange portion 220, for example), or has a local shrinkage in diameter (shaft portion 250, for example).

The flange portion 210 has a nearly rectangular shape as illustrated in FIG. 2, meanwhile the flange portion 220 has a nearly circular shape as illustrated in FIG. 5, with a plurality of notches 231, 232, 233 and 234 formed therein.

The shapes of the flange portion 210 and the flange portion 220 are merely illustrative ones, and may be modified, without impairing the operation and effect of the present invention, into various shapes including polygon, ellipse and cross.

The coil 300 is configured by winding a conducting wire around the shaft portion 250. The number of turns of the coil 300 and types of conducting wire are determined depending on desired specifications of the coil component 10. The number of turns of the coil 300 and the types of conducting wire are therefore not specifically limited when embodying the present invention.

The inner flange face 260 of the flange portion 210 means a face which is directed to the coil (coil 300) side, out of all faces of the flange portion 210, and is a lower face of the flange portion 210 in this embodiment.

The perimeter of the inner flange face 260 of the flange portion 210 means a boundary between the inner flange face 260 of the flange portion 210 and other regions.

The externally disposed regions 211, 212, 213, 214 mean regions of the flange portion 210, out of the perimeter of the inner flange face 260 of the flange portion 210, which fall outside of the inner face of the opening 110 in the radial direction.

More specifically, referring now to FIG. 2, the externally disposed region 211 is a region, out of the perimeter of the inner flange face of the flange portion 210, which overlaps with the bottom face of the recess 121 when viewed from the top. The externally disposed region 212 is a region, out of the perimeter of the inner flange face of the flange portion 210, which overlaps with the bottom face of the recess 122 when viewed from the top. The externally disposed region 213 is a region, out of the perimeter of the inner flange face of the flange portion 210, which overlaps with the bottom face of the recess 123 when viewed from the top. The externally disposed region 214 is a region, out of the perimeter of the inner flange face of the flange portion 210, which overlaps with the bottom face of the recess 124 when viewed from the top.

The internally disposed regions 215, 216, 217, 218 mean regions of the flange portion 210, out of the perimeter of the inner flange face 260 of the flange portion 210, which fall inside of the inner face of the opening 110 in the radial direction.

More specifically, referring now to FIG. 2, the internally disposed region 215 falls between the externally disposed region 211 and the externally disposed region 212. The internally disposed region 216 falls between the externally disposed region 212 and the externally disposed region 213. The internally disposed region 217 falls between the externally disposed region 213 and the externally disposed region 214. The internally disposed region 218 falls between the externally disposed region 214 and the externally disposed region 211.

The internally disposed region 215 is a region of the right side, as seen in FIG. 5, of the inner flange face 260 of the flange portion 210, and is visible from the side of bottom face 180. The internally disposed region 216 is a region of the lower side, as seen in FIG. 5, of the inner flange face 260 of the flange portion 210, and is visible from the side of bottom face 180. The internally disposed region 217 is a region of the left side, as seen in FIG. 5, of the inner flange face 260 of the flange portion 210, and is visible from the side of bottom face 180. The internally disposed region 218 is a region of the upper side, as seen in FIG. 5, of the inner flange face 260 of the flange portion 210, and is visible from the side of bottom face 180.

The radial direction of flange portion 210 is almost synonymous to the radial direction centered round a center axis 240 of the shaft portion 250, or centered round an axis of winding of the coil 300.

As illustrated in FIG. 2, the perimeter of the flange portion 210 is configured by sets of adjacent ones of the externally disposed regions 211, 212, 213, 214 and of the internally disposed regions 215, 216, 217, 218, and each set of the externally disposed region and the internally disposed region are arranged at nearly regular intervals.

Referring now to FIG. 2, the sets are arranged counterclockwise, in the order of [externally disposed region 211 and internally disposed region 215]→[externally disposed region 212 and internally disposed region 216]→[externally disposed region 213 and internally disposed region 217]→[externally disposed region 214 and internally disposed region 218], with the length in the perimeter direction of each set kept nearly constant.

The length in the perimeter direction of the internally disposed regions 215, 216, 217, 218 is longer than the length in the perimeter direction of the externally disposed regions 211, 212, 213, 214.

According to the configuration described in the previous paragraph, since the gaps 111, 112, 113, 114, which are formed between the internally disposed regions 215, 216, 217, 218 and the inner face of the opening 110, are arranged nearly in an evenly distributed manner, so that the resin to be filled, and air bubbles which possibly stay in the resin may be discharged more smoothly out from the coil component 10.

Since the length, in the perimeter direction, of the internally disposed regions 215, 216, 217, 218 is longer than the length, in the perimeter direction, of the externally disposed regions 211, 212, 213, 214, the air bubbles which possibly stay in the resin may be discharged more effectively than in the reverse case.

As illustrated in FIG. 1 and FIG. 2, the annular core 100 has recesses 120 formed on one surface having the opening 110 formed therein, and the externally disposed regions 211, 212, 213, 214 are fitted to the recesses 120.

The recesses 120 in this embodiment include a recess 121 to which the externally disposed region 211 is fitted, a recess 122 to which the externally disposed region 212 is fitted, a recess 123 to which the externally disposed region 213 is fitted, and a recess 124 to which the externally disposed region 214 is fitted.

The fitting of the externally disposed regions 211, 212, 213, 214 to the recesses 120 in this context means that the externally disposed regions 211, 212, 213, 214 and the recesses 120, which are designed to match each other, are mated. Modes of fitting include both of a mode in which the externally disposed regions 211, 212, 213, 214 are pressed against the recesses 120 to establish close contact, and a mode in which the externally disposed regions 211, 212, 213, 214 are loosely fitted to the recesses 120 while keeping a clearance in between.

Since the flange portion 210 is fitted to the recesses 120, relative position of the annular core 100 and the columnar core 200 is adjustable with reference to the recesses 120.

The recesses 120 in this embodiment are also portions provided as margins for pasting on which an adhesive is applied. The bottom faces of the recesses 120 and the lower face of the flange portion 210 are fixed by adhesion.

As illustrated in FIG. 2, the flange portion 210 is formed into a near rectangle, meanwhile the opening 110 is opened in a near circle. The inner diameter of the opening 110 is preferably larger than one side of the flange portion 210, and shorter than the diagonal of the flange portion 210. With such configuration, four corners of the flange portion 210 may be fixed to the annular core 100 (recesses 120), to thereby stabilize the immobilization of the annular core 100 and the columnar core 200.

As illustrated in FIG. 2, an apex portion 230 formed at the side end of the flange portion 210 is located in the externally disposed region 211. The recess 121 has, formed in a part thereof, a corner portion 150 which is conformal to the shape of the apex portion 230. By fitting the apex portion 230 to the corner portion 150, the columnar core 200 and the annular core 100 are limited to cause relative positional change.

More specifically, the apex portion 230 and the corner portion 150 are formed into an L-shape (near right angle). By bringing the side face of the apex portion 230 and the side face of the corner portion 150 into contact with each other, the columnar core 200 and the annular core 100 are mutually aligned with reference to the contact point.

Since the apex portion 230 and the corner portion 150 are aligned by the mutual contact, positioning of the individual components will not largely vary from product to product, and thereby a desired level of alignment will be achieved. Accordingly, the layout and size of the gap (including gaps 111, 112, 113, 114), formed as flow channels for the resin between the individual components, may be stabilized with high reproducibility.

The distance from the perimeter of the flange portion 210 to the side face of the recesses 120 is preferably smaller in a portion of the externally disposed region 211 having the apex portion 230 formed therein, and larger in the other externally disposed regions 212, 213, 214. In other words, as compared with the gap between the apex portion 230 provided as a reference point for limiting the relative position and the corner position 150, the gaps between the other externally disposed regions 212, 213, 214 and the side faces of the recesses 122, 123, 124 are given a larger allowance.

This facilitates fitting of the flange portion 210 to the recesses 120, and, fixation by adhesion of the flange portion 210 to the recesses 120, and thereby relieves the workload.

"The distance from the perimeter of the flange portion 210 to the side face of the recesses 120" explained in the previous paragraph allows that the distance is zero. For example, the distance between the apex portion 230 and the corner portion 150, in this embodiment explained above, equals almost zero since they are brought into contact. The phrase above also allows such case.

As has been described above, the annular core 100 has a top face 170 having the opening 110 provided therein, and a bottom face 180 positioned opposite to the top face 170.

As illustrated in FIG. 3 and FIG. 4, the housing portion 140 extends through the annular core 100 from the opening 110 provided to the top face 170 to the bottom face 180.

As illustrated in FIG. 4 and FIG. 5, the bottom face 180 includes a mounting face (plated surface 131*a*, for example) which is brought into contact with a board 410 (see FIG. 6) when the coil component 10 is mounted on the board 410, and offset faces 135, 136, 137, 138 and 131*b* to 131*d* which are kept apart from the board 410. The offset faces 131*b* to 131*d* are plated surfaces described later.

A part of the offset faces, or, offset faces 135, 136, 137 and 138 are respectively positioned right under the gaps 111, 112, 113, 114 formed between the inner face of the opening 110 and the internally disposed regions 215, 216, 217, 218. More specifically, the offset face 135 is provided right under the gap 111 (internally disposed region 215), the offset face 136 is provided right under the gap 112 (internally disposed region 216), the offset face 137 is provided right under the gap 113 (internally disposed region 217), and the offset face 138 is provided right under the gap 114 (internally disposed region 218). Now "right under the gaps 111, 112, 113, 114" indicates regions which lie in the same direction with the individual gaps when viewed from the center (shaft portion 250) of the coil component 10, and lie in the lower side near the bottom face 180 than the top face 170 in the direction normal to the top face 170.

With the configuration described in the previous paragraph, when the coil component 10 is encapsulated and molded with the resin 430 on the board 410 (see FIG. 6), the gaps formed between the board 410 and the offset faces 135, 136, 137, 138 communicate with the inner space of the housing portion 140, and with the gaps between the flange portion 210 and the opening 110 (gap 111, for example), to produce the flow channels for the resin. Accordingly, from whichever direction the resin flows, or, from the top face 170 side or from the bottom face 180 side, air bubbles in the resin may be discharged through the other side, and thereby air bubbles may be prevented from staying.

As illustrated in FIG. 3 and FIG. 5, the flange portion 210 is formed at one end of the shaft portion 250, and the flange portion 220 (other flange portion) is formed at the other end of the shaft portion 250. The flange portion 220 has a plurality of notches 231, 232, 233, 234, and one notch 231 is being cut deeper than the other notches 232, 233, 234.

The notches 231, 232, 233, 234 in this embodiment are formed so that the flange portion 220 is cut from the perimeter towards the axis of winding of the coil 300 (center axis 240).

The notch 231 has a shape which is cut deeply close to the shaft portion 250 around which the coil 300 is wound. With such shape of the notch 231 which is cut as deeply as possible, it is now possible to keep a flow channel through which air bubbles retained below the flange portion 220 can migrate upward, and thereby the air bubbles may be prevented from staying. A certain level or more of strength of the flange portion 220 may be ensured, by forming only a part of the notches (notch 231) to have the deep-cut geometry, rather than forming all notches (notches 231, 232, 233, 234) to have the deep-cut geometry.

The flange portion 220 is positioned in the inner space of the housing portion 140, and, spaced from the housing portion 140. Since the flange portion 220 is spaced from the housing portion 140, it is now possible to create the flow channel for the resin in the spaced portion. By properly determining the size of the spaced portion, the spaced portion can now serve as a coil gap, thereby the inductance value and DC superimposition characteristic of the coil component 10 are adjustable in a successful manner.

The inner space of the housing portion 140 means a space embraced by the annular core 100 from the top face 170 to the bottom face 180 thereof, and the wall composing the housing portion 140. Accordingly, the phrase of "the flange portion 220 is positioned in the inner space of the housing portion 140" means that the flange portion 220 is inserted into the housing portion 140; that the upper face of the flange portion 220 is positioned at a level lower than that of the top face 170 of the annular core 100; and, that the lower face of the flange portion 220 is positioned at a level higher than that of the bottom face 180 of the annular core 100.

As illustrated in FIG. 3 and FIG. 5, the mounting face (plated surface 131*a*, for example) is plated, to which a terminal of the coil 300 (lead wire 310, for example) drawn out from any one of the notches (notch 231, for example) is connected.

More specifically, the connection of the lead wire 310 and the plated surface 131*a* which serves as the mounting face is as follows.

In apart of the bottom face 180, an electrode portion 131, which is configured by the plated surface 131*a*, a plated surface 131*b*, a plated surface 131*c*, a plated surface 131*d* and a plated surface 131*e*, is formed by plating.

The plated surface 131*a* and the plated surface 131*e* are faces configuring the lowermost parts of the bottom face 180, and serve as the mounting faces.

The plated surface 131*c* is recessed from the plated surface 131*a* or the plated surface 131*e*, so that a fillet of solder at the joined portion 311, which is formed on the plated surface 131*c* in order to solder thereon the lead wire 310, will not protrude down from the mounting face. In other words, the plated surface 131*c* is positioned above the level of plated surface 131*a* or plated surface 131*e* (mounting face).

The plated surface 131*b* and the plated surface 131*d* are formed by plating over an area between the plated surface 131*c* and the plated surface 131*a*, and, over an area between the plated surface 131*c* and the plated surface 131*e*, respectively. In this way, the area ranging from the plated surface 131*a* to the plated surface 131*e* is electrically connected to thereby form the electrode portion 131.

By such plating and soldering, the lead wire 310 is electrically connected to the plated surface 131*a* and the plated surface 131*e* which serve as the mounting faces, so that when the coil component 10 is mounted on the board 410, the coil 300 and the other electronic component 420 can configure the electronic circuit 400 (see FIG. 6).

Also the other electrode portions 132, 133, 134 are plated in the same way as described in the previous paragraph. Also the lead wire 330 and the electrode portion 133 are soldered in the same way as described in the previous paragraph, and thereby a joined portion 331 is formed in the electrode portion 133 (see FIG. 3 and FIG. 5).

With such configuration, the number of components of the coil component 10 as a whole may be reduced. Since a joined portion of the individual components is one of portions where air bubbles tend to reside, so that reduced number of components will be effective to suppress the residence of air bubbles.

As described previously, the plated surface 131*c* on which the joined portion 311 with the lead wire 310 is formed is recessed from the plated surface 131*a* or the plated surface 131*e* which serve as the mounting faces, so that when the coil component 10 is mounted on the board 410 (see FIG. 6), a gap is formed between the electrode portion 131 (plated surface 131*c*) and the board 410. Also the electrode portion 132, the electrode portion 133 and the electrode portion 134 are mounted on the board 410, while creating gaps in between in the same way as the electrode portion 131.

As illustrated in FIG. 2 and FIG. 5, the offset face (the plated face) 131*c* is provided as other part of the offset faces, right under the externally disposed region 211, and, a round-bottom trench 141 is formed in the housing portion 140 in series with the offset face 131*c*. The offset face 131*c* is a plated surface composing the electrode portion 131, and is recessed from the plated surface 131*a* and the plated surface 131*e* which are the mounting faces. A gap is therefore created between the board 410 and the offset face 131*c*. The same will apply to other electrode portions 132, 133, 134 provided right under the externally disposed regions 212, 213, 214, where round-bottom trenches 142, 143, 144 are formed in the housing portion 140, respectively in series with the recessed portions in the electrode portions 132, 133, 134. Now the round-bottom trench means a long narrow recess having a curved bottom face.

The configuration described in the previous paragraphs will be summarized as follows.

That is, the trench 141 and the electrode portion 131 are formed in series in the vicinity of the externally disposed region 211. The trench 142 and the electrode portion 132 are formed in series in the vicinity of the externally disposed region 212. The trench 143 and the electrode portion 133 are formed in series in the vicinity of the externally disposed region 213. The trench 144 and the electrode portion 134 are formed in series in the vicinity of the externally disposed region 214.

A portion around each of the externally disposed regions 212, 213, 213, 214 is one of regions where air bubbles tend to reside. As a part of countermeasures, there are provided the trenches (trench 141, for example) and the gaps (electrode portion 131, for example) to create the flow channels for the resin and air bubbles. In this way, the resin may be filled smoothly in the encapsulation and molding process, while suppressing residence of air bubbles.

Since each trench is rounded at the bottom, air bubbles are more unlikely to reside, as compared with a square-cornered trench.

As illustrated in FIG. 5, the notch 231 and the trench 141; the notch 232 and the trench 142; the notch 233 and the trench 143; and the notch 234 and the trench 144 are arranged respectively so as to oppose to each other.

In this configuration, at around the portions right under the externally disposed regions 211, 212, 213, 214, since the annular core 100 and the columnar core 200 (coil 300) are spaced more widely than in the other portion, so that the flow channels for the resin are widened, and thereby the effect of suppressing residence of air bubbles described in the previous paragraphs will become more evident.

In this embodiment, there are also provided the notches 232, 234 having no terminal of coil 300 drawn therefrom, and the electrode portions 132, 134 having no terminal of the coil 300 connected thereto. They are provided for the purpose of making the coil component 10 compatible to a variety of patterns of mounting on the board 410 (see FIG. 6). Accordingly, the terminals of the coil 300 may be drawn out from the notches 232, 234, and the terminals of the coil 300 may be connected to the electrode portions 132, 134.

As has been described above, since the coil component 10 of this embodiment is configured by fitting the edges of the flange portion 210 to the recesses 120, it is now possible to adjust the relative position of the annular core 100 and the columnar core 200. Since the coil component 10 of this embodiment makes every effort of ensuring the flow channels through which the resin to be filled can flow in the process of encapsulation and molding, so that air bubbles may be prevented from staying inside.

<Coil Component 50>

Figure 7:
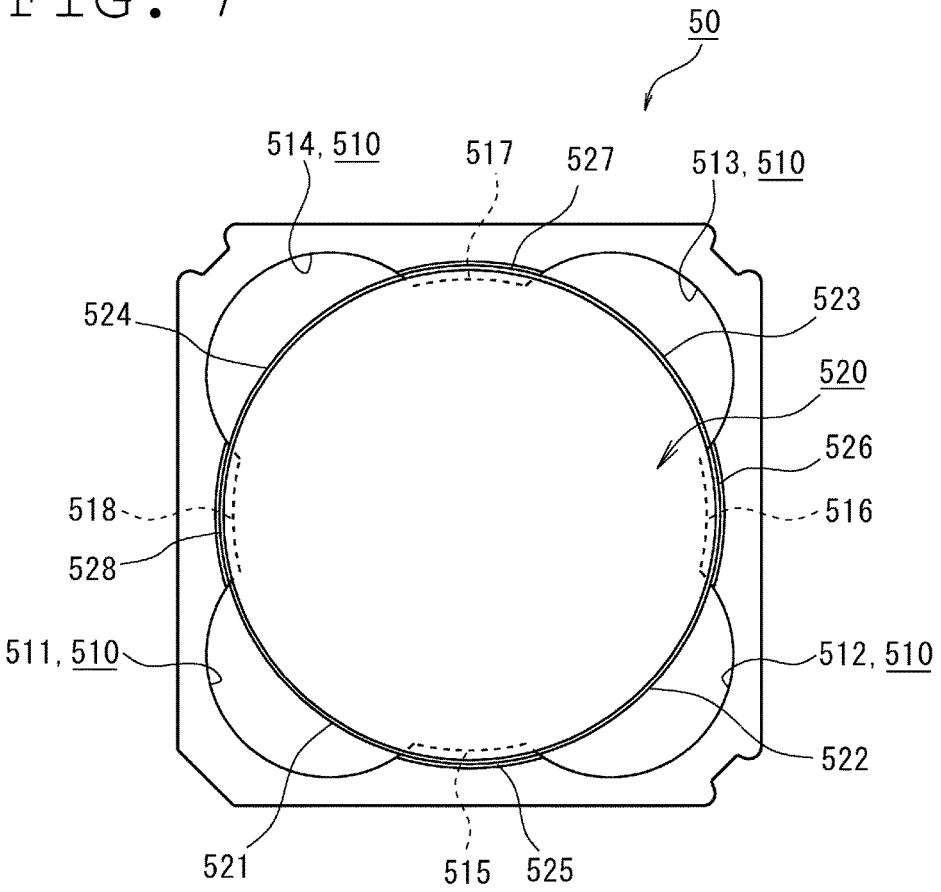
FIG. 7 is a plan view of a coil component, viewed from the top face, according to a modified example of the present invention.

Next, a coil component 50 as a modified example of the above-described embodiment will be explained, referring to FIG. 7. FIG. 7 is a plan view of the coil component 50, according to the modified example of the present invention, viewed from the top face.

In the coil component 50, differences reside in the shape of a flange portion 520 which corresponds to the flange portion 210 of the coil component 10, and in the shape of an opening 510 which corresponds to the opening 110 of the coil component 10. The flange portion 520 is fitted to recesses 515, 516, 517, 518, where position and shape of the recesses 515, 516, 517, 518 are different from those of the recesses 120 (121, 122, 123, 124) of the coil component 10.

Other constituents and features thereof are same as those of the coil component 10, and will not be explained again.

As illustrated in FIG. 7, the opening 510 has a near-circular shape, and has at four corners thereof trenches 511, 512, 513, 514 formed so as to recess outwardly in the radial direction. The trenches 511, 512, 513, 514 are rounded so that air bubbles are unlikely to reside therein.

Also the flange portion 520 is formed into a near-circle, and the perimeter of the flange portion 520 is fitted to the recesses 515, 516, 517, 518.

Externally disposed regions 525, 526, 527, 528 in the coil component 50 mean regions of the flange portion 520, out of the perimeter of the inner flange face of the flange portion 520, which fall outside of the inner face of the opening 510 in the radial direction.

More specifically, referring now to FIG. 7, the externally disposed region 525 is a region, out of the perimeter of the inner flange face of the flange portion 520, which overlaps with the bottom face of the recess 515 when viewed from the top. The externally disposed region 526 is a region, out of the perimeter of the inner flange face of the flange portion 520, which overlaps with the bottom face of the recess 516 when viewed from the top. The externally disposed region 527 is a region, out of the perimeter of the inner flange face of the flange portion 520, which overlaps with the bottom face of the recess 517 when viewed from the top. The externally disposed region 528 is a region, out of the perimeter of the inner flange face of the flange portion 520, which overlaps with the bottom face of the recess 518 when viewed from the top.

The internally disposed regions 521, 522, 523, 524 of the coil component 50 mean regions of the flange portion 520, out of the perimeter of the inner flange face of the flange portion 520, which fall inside of the inner face of the opening 510 in the radial direction.

More specifically, referring now to FIG. 7, the internally disposed region 521 falls between the externally disposed region 528 and the externally disposed region 525. The internally disposed region 522 falls between the externally disposed region 525 and the externally disposed region 526. The internally disposed region 523 falls between the externally disposed region 526 and the externally disposed region 527. The internally disposed region 524 falls between the externally disposed region 527 and the externally disposed region 528.

The coil component 50 described above is same as the coil component 10, in that the externally disposed regions 525, 526, 527, 528 fall outside the inner face of the opening 510, and that the internally disposed regions 521, 522, 523, 524 fall inside the inner face of the opening 510.

Accordingly, in the process of encapsulation and molding, the resin can flow through the gaps formed between the perimeter of the flange portion 520 and the inner face of the opening 510, thereby the amount of air bubbles which possibly stay inside the coil component 50 may be reduced.

The present invention has been explained referring to the embodiment and the modified example, merely for illustrative purpose. Each of the various constituents of the present invention is not always necessarily an independent something that exists, instead allowing that a plurality of constituents are configured to give a single constituent; that a single constituent is formed by a plurality of divisional constituents; that a certain constituents is a part of other constituent; and that a part of a certain constituent overlaps with a part of other constituent.

The various constituents described above are not always necessarily essential constituents, and instead, they may be omitted so long as the effects of the present invention will not be impaired, or they may be replaced by other constituents having identical functions and operations.

According to the present invention, there is provided a coil component capable of preventing the internal residence of air bubbles when encapsulated with a resin, and, an electronic circuit incorporating the coil component.

It is apparent that the present invention is not limited to the above embodiment, and may be modified and changed without departing from the scope and spirit of the invention.

This embodiment also embraces the technical spirits below:

(1) A coil component which includes:

a columnar core which includes a shaft portion having a coil wound therearound, and a flange portion formed at least at one end portion of the shaft portion, given a diameter larger than that of the shaft portion; and an annular core which includes an opening through which the columnar core is inserted, and a housing portion which houses the columnar core inserted through the opening, the perimeter of an inner flange face of the flange portion being configured by an externally disposed region which is positioned outside the inner face of the opening in the radial direction, and an internally disposed region which is positioned inside the inner face of the opening in the radial direction.

(2) The coil component according to (1), wherein the perimeter is configured by sets of every adjacent externally disposed region and the internally disposed region, each set of the externally disposed region and the internally disposed region being arranged at nearly regular intervals, and the internally disposed region has the length in the perimeter direction larger than the length in the perimeter direction of the externally disposed region.

(3) The coil component according to (1) or (2), wherein the flange portion is formed in a nearly rectangular shape, the opening has a nearly circular shape, and the inner diameter of the opening is larger than one side of the flange portion, and shorter than the diagonal of the flange portion.

(4) The coil component according to any one of (1) to (3), wherein the annular core has a recess formed on one face in which the opening is formed, and the externally disposed region is fitted to the recess.

(5) The coil component according to (4), wherein the flange portion has, formed on the edge thereof, an apex portion which is positioned in the externally disposed region, the recess has, formed in a part thereof, a corner portion which is conformal to the shape of the apex portion, and the columnar core and the annular core are limited to cause relative positional change, by fitting the apex portion to the corner portion.

(6) The coil component according to (4) or (5), wherein the distance from the perimeter to the side face of the recess is smaller in a part of the externally disposed regions having the apex portion formed therein, and larger in the other externally disposed region(s).

(7) The coil component according to any one of (3) to (6), wherein the annular core has a top face having the opening provided therein, and a bottom face positioned opposite to the top face, the housing portion extends through the annular core from the opening provided to the top face to the bottom face, the bottom face includes mounting faces which are brought into contact with a board when mounted on the board, and offset faces which are kept apart from the board, and at least apart of the offset faces is positioned right under a gap between the inner face of the opening and the internally disposed region.

(8) The coil component according to (7), wherein other part of the offset faces is provided to the bottom face right under the externally disposed region, and, a round-bottom trench is formed in the housing portion in series with the other part of the offset faces.

(9) The coil component according to any one of (3) to (8), wherein other flange portion is formed at the other end of the shaft portion opposite to the side the flange portion is formed, and the other flange portion has a plurality of notches, one of the notches being cut deeper than the other notch(es).

(10) The coil component according to (9) dependent to (7) or (8), wherein the mounting face is plated, and the terminal of the coil drawn out through the notch is electrically connected to the mounting face.

(11) An electronic circuit which includes the coil component described in (1) and other electronic component(s) mounted together on a board, and, at least the coil component being encapsulated with a resin.

(12) The electronic circuit according to (11), wherein the coil component and the other electronic component(s) are encapsulated together with the resin.

What is claimed is:

1. A coil component comprising:

a columnar core including a shaft and a flange provided at one end of the shaft, a diameter of the flange being larger than a diameter of the shaft, an outer flange periphery of the flange having first and second flange peripheries;

a wire wound around the shaft forming a coil; and an annular core including a housing and an opening provided in the housing, the columnar core being inserted into the housing of the annular core so that the opening is partially occupied by the flange in a plan view, wherein the first flange periphery is overlapped with a first closest inner edge of the housing in a plan view, and the second flange periphery is spaced apart from a second closest inner edge of the housing in the plan view.

2. The coil component according to claim 1, wherein the outer flange periphery of the flange includes a plurality of pairs of first and second flange peripheries, and the plurality of pairs of first and second flange peripheries are sequentially provided at substantially equal intervals, and a peripheral length of the first flange periphery is smaller than a peripheral length of the second flange periphery.

3. The coil component according to claim 1, wherein the flange is in a nearly rectangular shape, the opening is in a nearly circular shape, and an inner diameter of the opening is larger than one side of the flange, and the inner diameter of the opening is shorter than a diagonal of the flange.

4. The coil component according to claim 1, wherein the annular core has a recess formed on one face in which the opening is formed, and the first flange periphery is fitted to the recess.

5. The coil component according to claim 4, wherein the flange has an apex in an edge thereof, the apex is positioned in the first flange periphery, the recess has a corner portion therein which corresponds to the shape of the apex, and after the apex is fitted in the corner, relative movement between the columnar core and the annular core is limited.

6. The coil component according to claim 5, wherein the outer flange periphery of the flange includes a plurality of pairs of first and second flange peripheries, and the recess further comprises a plurality of recesses including first and second recesses, wherein a distance from an edge of one of the first flange peripheries to an inner wall of the first recess is smaller than a distance from an edge of another of the first flange peripheries to an inner wall of the second recess, and the one of the first flange peripheries has the apex, and the another of the first flange peripheries is spaced apart from the apex.

7. The coil component according to claim 3, wherein the annular core has a top face having the opening provided therein, and a bottom face positioned opposite to the top face, the housing extends through the annular core from the top face to the bottom face so that the opening is a through hole provided in the housing, the bottom face includes a mounting face which is brought into contact with a board after the coil component is mounted on the board, and the bottom face includes an offset face which is spaced apart from the board, and part of the offset face is positioned immediately under a gap between an inner face of the opening and an edge of the second flange periphery in the plan view.

8. The coil component according to claim 7, wherein another part of the offset face is positioned immediately under the first flange periphery in the plan view, and a round-bottom trench is formed in the housing, and the round-bottom trench is continuously formed with the another part of the offset face.

9. The coil component according to claim 3, wherein another flange is formed at the other end of the shaft opposite to the one end of the shaft, and the another flange has a plurality of notches, one of the notches is cut deeper than the other of the notches.

10. The coil component according to claim 7, wherein another flange is formed at the other end of the shaft opposite to the one end of the shaft, and the another flange has a plurality of notches, one of the notches is cut deeper than the other of the notches.

11. The coil component according to claim 10, wherein the mounting face is plated, and an end of the wire drawn out through one of the notches is electrically connected to the mounting face.

12. An electronic circuit comprising:

the coil component of claim 1;

an electronic component mounted on a board together with the coil component; and a resin encapsulating the coil component.

13. The electronic circuit according to claim 12, wherein the coil component and the electronic component are encapsulated together with the resin.

14. A coil component comprising:

a columnar core having a shaft, the shaft having a coil wound therearound, the columnar core having a flange formed at least at one end of the shaft, a diameter of the flange being larger than a diameter of the shaft; and an annular core having an opening through which the columnar core is inserted, the annular core having a housing which houses the columnar core inserted through the opening, wherein a perimeter of an inner flange face of the flange includes an externally disposed region which is located radially outside an inner face of the opening and an internally disposed region which is located radially inside the inner face of the opening, wherein the annular core has a recess in one face in which the opening is formed, the externally disposed region is fitted to the recess, wherein the flange has an apex in an edge thereof, the apex is located in the externally disposed region, the recess has a corner which corresponds to the shape of the apex, and after the apex is fitted in the corner, relative movement between the columnar core and the annular core is limited.

15. The coil component according to claim 14, wherein the externally disposed region further comprises a plurality of externally disposed regions including first and second externally disposed regions, and the recess further comprises a plurality or recesses including first and second recesses, wherein a distance from the perimeter of the flange to an inner wall of the first recess in the first externally disposed region is smaller than a distance from the perimeter of the flange to an inner wall of the second recess in the second externally disposed region, and the first externally disposed region has the apex, and the second externally disposed region is spaced apart from the apex.

16. A coil component comprising:

a columnar core having a shaft, the shaft having a coil wound therearound, the columnar core having a flange formed at one end of the shaft, a diameter of the flange being larger than a diameter of the shaft; and an annular core having an opening through which the columnar core is inserted, the annular core having a housing which houses the columnar core inserted through the opening, wherein a perimeter of an inner flange face of the flange includes an externally disposed region which is located radially outside an inner face of the opening and an internally disposed region which is located radially inside the inner face of the opening, wherein the flange is in a nearly rectangular shape, the opening is in a nearly circular shape, an inner diameter of the opening is larger than one side of the flange, and the inner diameter of the opening is shorter than a diagonal of the flange, wherein another flange is formed at the other end of the shaft opposite to the one end of the shaft, and the another flange has a plurality of notches, and one of the notches is cut deeper than the other of the notches.

* * * * *